US005882733A

United States Patent [19]

Sokolowski

[11] Patent Number: 5,882,733

[45] Date of Patent: Mar. 16, 1999

[54] CONTINUOUS GALVANIZING METHOD

[75] Inventor: Richard Bruno Sokolowski, Raches, France

[73] Assignee: Union Miniere France S.A., Ragnolet, France

[21] Appl. No.: 934,897

[22] PCT Filed: Oct. 8, 1993

[86] PCT No.: PCT/EP93/02754

§ 371 Date: Apr. 10, 1995

§ 102(e) Date: Apr. 10, 1995

[87] PCT Pub. No.: WO94/09173

PCT Pub. Date: Apr. 28, 1994

Related U.S. Application Data

[63] Continuation of Ser. No. 416,865, Apr. 10, 1995, abandoned.

[30] Foreign Application Priority Data

Oct. 13, 1992 [FR] France ..... 92/12213

[51] Int. Cl.[6] ..... B05D 1/36

[52] U.S. Cl. ..... 427/404; 427/405; 427/406; 427/433; 427/436

[58] Field of Search ..... 427/404, 405, 427/406, 433, 436

[56] References Cited

U.S. PATENT DOCUMENTS

| | | | |
|---|---|---|---|
| 4,330,598 | 5/1982 | Lee et al. | 428/653 |
| 4,369,211 | 1/1983 | Nitto et al. | 427/349 |
| 4,987,037 | 1/1991 | Wilde et al. | 428/653 |

FOREIGN PATENT DOCUMENTS

| | | | |
|---|---|---|---|
| 3734203 | 4/1989 | Germany . | |
| 61-052337 | 3/1986 | Japan | C22C 18/00 |
| 62-040352 | 2/1987 | Japan | C23C 2/28 |
| 3-68748 | 3/1991 | Japan . | |
| 4-218655 | 8/1992 | Japan | C23C 2/28 |
| 4-235266 | 8/1992 | Japan . | |

OTHER PUBLICATIONS

Translated Table of Contents for Chapter of "*Les Techniques De L'Ingenieur*" pM1525–1, Jul. 1993 now present Feb. 12, 1998.

*Primary Examiner*—Felisa Garrett
*Attorney, Agent, or Firm*—Antonelli, Terry, Stout & Kraus, LLP

[57] ABSTRACT

Process for continuously galvanizing steel sheet by passing the sheet through a bath consisting of zinc, aluminium and silicon, the aluminium content ranging from 0.05% to 0.5% by weight and the silicon content from 0.005% by weight up to saturation.

There is neither formation of aluminiferous floating dross nor formation of bottom dross in such a bath.

8 Claims, No Drawings

CONTINUOUS GALVANIZING METHOD

This application is a continuation of Application Ser. No. 08/416,865 filed Apr. 10, 1995 and now abandoned.

FIELD OF THE INVENTION

The present invention relates to a process for producing, in succession, steel sheet coated with an iron-zinc alloy and conventional galvanized steel sheet on one and the same continuous galvanizing line, without interrupting the operation of this line, according to which process one produces a quantity of steel sheet coated with an iron-zinc alloy by passing the steel sheet through a bath of aluminiferous zinc containing less than approximately 0.15% by weight of aluminium and by subjecting the zinc-coated sheet thus obtained to a diffusion heat treatment so as to convert the layer of zinc present on the sheet into a zinc-iron alloy, and then one passes directly to the production of a quantity of conventional galvanized steel sheet by raising the aluminium content of the bath to more than approximately 0.15%, continuing to pass the steel sheet through the bath and dispensing with the diffusion heat treatment.

BACKGROUND ART

In the continuous galvanizing of steel sheet, it is known that either a bath consisting of zinc and 0.10%–<0.15% by weight of aluminium or a bath consisting of zinc and >0.15–0.20% by weight of aluminium is most often used. The first type of bath is employed when the zinc-coated sheet, after the coating has been wiped, is subjected to a diffusion heat treatment so as to transform the zinc coating into a coating of an iron-zinc alloy, this commonly being called "galvannealing". The second type of bath is used to produce conventional galvanized product, that is to say sheet coated with a thin layer of zinc. If the bath contains less than 0.12% of aluminium, a whole range of iron-zinc compounds, as is described in the zinc-iron phase diagram, is formed at the interface between the iron and the zinc, which compounds are to be avoided in the production of conventional galvanized product. In order to prevent any nucleation of the δ phase, the aluminium must, in fact, be greater than 0.15%. This is the reason why the second type of bath has an aluminium content of more than 0.15%. For an aluminium content of approximately 0.15%, a very thin layer of $Fe_2Al_5$ alloy, which will act as a barrier to any subsequent diffusion, is formed at the surface of the steel. This is the reason why the first type of bath has an aluminium content of less than 0.15%. However, this first type of bath requires the presence of at least approximately 0.10% of aluminium in order to slow down the reaction between the iron and the zinc while the sheet is passing through the bath; otherwise, this reaction would give rise to an excessive growth of the coating in the bath. Although slowed down by the aluminium, the reaction between the iron and the zinc nevertheless causes the formation of iron-zinc dross which accumulates at the bottom of the bath and which is consequently called bottom dross. This bottom dross stops being formed as soon as the aluminium content exceeds 0.15%; it therefore does not form in the second type of bath. In the second type of bath, part of the aluminium reacts with the iron of the sheet in order to form $Fe_2Al_5$ compounds commonly called floating dross. It is also known that, in the continuous galvanizing world, three categories of galvanizers exist: those which just make "galvannealed" sheet, those which just make conventional galvanized sheet and those which make alternately, and without interruption, both types of sheets on one and the same galvanizing line. The latter use the first type of bath to make "galvannealed" sheet and the second type of bath to make conventional galvanized sheet, and they raise the aluminium content of the bath in order to pass from the first type of bath to the second: they therefore apply a process as defined hereinabove. This known process has the drawback that, because of the increase in the aluminium content of the bath when passing from the first to the second type of bath, the iron-zinc bottom dross existing in the bath at this moment will be progressively converted into iron-aluminium floating dross, and will rise and create defects on the sheet passing through the bath; there is therefore a risk of producing a substantial quantity of sheet of lower quality every time one passes from the production of "galvannealed" sheet to the production of conventional galvanized sheet.

SUMMARY OF THE INVENTION

The object of the present invention is to provide a process, as defined hereinabove, which avoids the drawback of this known process.

For this purpose, according to the invention, a bath of aluminiferous zinc is used which consists of zinc, aluminium and silicon, the silicon content ranging from 0.005% up to saturation and the aluminium content being at least 0.05% during production of steel sheet coated with an iron-zinc alloy and at the very most 0.5% during production of conventional galvanized sheet.

DESCRIPTION OF THE PREFERRED EMBODIMENT

It has been found that there is no formation of iron-zinc bottom dross in such a bath: hence is therefore no risk of producing a substantial quantity of sheet of lower quality when passing from production of "galvannealed" sheet to production of conventional galvanized sheet. In such a bath, it has furthermore been found that there is no formation of aluminiferous floating dross either. This observation is particularly important for the second facet of the process of the invention, namely the production of conventional galvanized sheet. During production of conventional galvanized sheet in the second type of bath of the prior art (Zn and>0.15–0.20% Al), it is indeed particularly difficult to control the composition of the bath judiciously during the galvanizing procedure on account of the fact that the bath becomes exhausted more quickly of aluminium than of zinc, precisely because of the formation of aluminiferous floating dross. It follows that, in practice, it is necessary to vary the aluminium content of the bath according to a toothed profile, running the risk of intermittently producing a coating of lower quality. Now, since there is no formation of aluminiferous dross in the process of the present invention, the rates of zinc and aluminium exhaustion of the bath are substantially equal, thereby making it particularly easy to control the composition of the bath. Small quantities of Fe-Si floating dross are actually formed, but these are in no way prejudicial to the galvanizing procedure: the coatings produced are of excellent quality.

It is disclosed in JP-A-4,218,655 and JP-A-4,235,266 to use a process for producing "galvannealed" sheet in which a bath is used consisting of Zn, 0.001–0.2% Si and 0.05–0.20% Al because the silicon and aluminium would improve the workability of the sheet. Since the bath used corresponds to that used in the process of the present invention, there should be no formation of bottom dross in this known process. However, this fact is not mentioned in these documents. It should also be noted here that JP-A-368,748, which concerns continuous galvanization in a zinc bath with 0.05–5% of Al, 0.005–0.8% of Si and 0.1–3% of Mn for the purpose of the production of "galvannealed" sheet or of conventional galvanized sheet and which deals with problems relating to the formation of both floating dross and bottom dross, formally advises against adding silicon to a Zn-Al galvanizing bath if this bath contains less than 5% of aluminium. Under these conditions, silicon would produce a deleterious effect, namely the formation of non-galvanized spots. The teaching afforded by document is therefore diametrically opposed to what has been found and proposed herein.

In the process of the invention, the aluminium content must be raised to at least 0.05% during production of "galvannealed" sheet, because there is a risk of forming coatings which are too thick at lower contents. It must not exceed 0.5% during production of conventional galvanized sheet, because otherwise there is a risk of causing continuity defects in the coating. A silicon content of at least 0.005% is required to prevent the formation of both bottom dross and aluminiferous dross. The bath may not be supersaturated with silicon, because a supersaturated bath may lead to defects in the coating.

It is desirable that the bath contain at least 0.10% of aluminium during production of "galvannealed" sheet. It is also desirable that the bath contains at least 0.01% and at most 0.10% of silicon.

Since the rates of zinc and aluminium exhaustion of the bath are substantially equal, it is appropriate to maintain the composition of the bath during the galvanizing procedure by compensating for the consumption of bath by the addition to the bath either of a zinc alloy with 0.05–0.5% of aluminium and 0.05–1.5% of silicon, the aluminium content of this alloy being substantially equal to the aluminium content of the bath, or of an equivalent of the said zinc alloy in the form of at least one master alloy and of zinc or in the form of at least one master alloy and of a zinc-based alloy containing fewer additives than the abovementioned alloy.

When, for example, conventional galvanized product is produced in a bath having 0.20% of Al, it is completely appropriate to top up this bath with a zinc alloy containing 0.20% of Al, for example an alloy having 0.20% of Al and 0.1% of Si, because the aluminium content of the bath is thus maintained all the time at the desired level of 0.20%. It is obvious that this alloy having 0.20% of Al and 0.1% of Si could be substituted with an equivalent formed, for example, in respect of 90% by zinc and in respect of 10% by a zinc alloy having 2% of Al and 1% of Si.

It is obvious that it is possible to take advantage of the bath used in the second aspect of the process of the present invention when only conventional galvanized product is to be produced. This is why application is also made for protection for a process for producing conventional galvanized steel sheet, according to which process steel sheet is passed through a bath of aluminiferous zinc containing more than approximately 0.15% by weight of aluminium and no diffusion heat treatment is applied to the coated sheet thus obtained, this process being characterized in that, as bath of aluminiferous zinc, a bath is used consisting of zinc, aluminium and silicon, the silicon content ranging from 0.005% up to saturation, preferably from 0.01 to 0.10%, and the aluminium content being at the very most 0.5%. In this process for continuous production of conventional galvanized product, it is appropriate to maintain the composition of the bath during the galvanizing procedure by compensating for the consumption of bath by the addition to the bath either of a zinc alloy with 0.16–0.5% of aluminium and 0.05–1.5% of silicon, the aluminium content of this alloy being substantially equal to the aluminium content of the bath, or of an equivalent of the said zinc alloy in the form of at least one master alloy and of zinc or in the form of at least one master alloy and of a zinc-based alloy containing fewer additives than the abovementioned alloy.

Typical examples of bath compositions which may be used in the process according to the invention are given hereinbelow:

Zn—0.07% Al—0.005% Si
Zn—0.07% Al—0.010% Si
Zn—0.07% Al—0.020% Si
Zn—0.07% Al—0.040% Si
Zn—0.07% Al—0.060% Si
Zn—0.07% Al—0.080% Si
Zn—0.07% Al—0.100% Si
Zn—0.10% Al—0.005% Si
Zn—0.10% Al—0.010% Si
Zn—0.10% Al—0.020% Si
Zn—0.10% Al—0.040% Si
Zn—0.10% Al—0.060% Si
Zn—0.10% Al—0.080% Si
Zn—0.10% Al—0.100% Si
Zn—0.12% Al—0.005% Si
Zn—0.12% Al—0.010% Si
Zn—0.12% Al—0.020% Si
Zn—0.12% Al—0.040% Si
Zn—0.12% Al—0.060% Si
Zn—0.12% Al—0.080% Si
Zn—0.12% Al—0.100% Si
Zn—0.14% Al—0.005% Si
Zn—0.14% Al—0.010% Si
Zn—0.14% Al—0.020% Si
Zn—0.14% Al—0.040% Si
Zn—0.14% Al—0.060% Si
Zn—0.14% Al—0.080% Si
Zn—0.14% Al—0.100% Si
Zn—0.16% Al—0.005% Si
Zn—0.16% Al—0.010% Si
Zn—0.16% Al—0.020% Si
Zn—0.16% Al—0.040% Si
Zn—0.16% Al—0.060% Si
Zn—0.16% Al—0.080% Si
Zn—0.16% Al—0.100% Si
Zn—0.18% Al—0.005% Si
Zn—0.18% Al—0.010% Si
Zn—0.18% Al—0.020% Si
Zn—0.18% Al—0.040% Si
Zn—0.18% Al—0.060% Si
Zn—0.18% Al—0.080% Si
Zn—0.18% Al—0.100% Si
Zn—0.20% Al—0.005% Si
Zn—0.20% Al—0.010% Si

Zn—0.20% Al—0.020% Si
Zn—0.20% Al—0.040% Si
Zn—0.20% Al—0.060% Si
Zn—0.20% Al—0.080% Si
Zn—0.20% Al—0.100% Si
Zn—0.25% Al—0.005% Si
Zn—0.25% Al—0.010% Si
Zn—0.25% Al—0.020% Si
Zn—0.25% Al—0.040% Si
Zn—0.25% Al—0.060% Si
Zn—0.25% Al—0.080% Si
Zn—0.25% Al—0.100% Si
Zn—0.30% Al—0.005% Si
Zn—0.30% Al—0.010% Si
Zn—0.30% Al—0.020% Si
Zn—0.30% Al—0.040% Si
Zn—0.30% Al—0.060% Si
Zn—0.30% Al—0.080% Si
Zn—0.30% Al—0.100% Si
Zn—0.40% Al—0.005% Si
Zn—0.40% Al—0.010% Si
Zn—0.40% Al—0.020% Si
Zn—0.40% Al—0.040% Si
Zn—0.40% Al—0.060% Si
Zn—0.40% Al—0.080% Si
Zn—0.40% Al—0.100% Si

These compositions may be employed at temperaures from 430° to 510° C., that is to say at temperatures which are normally used in continuous galvanizing. However, it may be useful to operate at higher temperaures with the compositions having more than 0.06% of silicon. Needless to say, the compositions having up to 0.14% Al will be used during production of "galvannealed" sheet and those having at least 0.16% Al will be employed during production of conventional galvanized product.

The expression "a bath consisting of zinc, aluminium and silicon", used in this application, should be understood to mean a bath which contains only these three metals, the impurities inevitably present in these metals and the impurities introduced into the bath by the passage of the sheet.

As regards the preparation of the surface of the sheet, the passage of the sheet through the bath, the wiping of the coating, its possible heat treatment and its cooling, it is obvious that recourse may be had to well-known techniques, for example to the techniques described in the chapter entitled "Continuous galvanizing and aluminizing" in "Les techniques de l'Ingénieur", M 1525, 1–13.

I claim:

1. A process for producing, in succession, firstly, a quantity of steel sheet coated with an iron-zinc alloy and, secondly, a quantity of galvanized steel sheet on the same continuous galvanizing line without interrupting the operation of this line, comprising the steps of:

a) passing a first quantity of steel sheet through a bath having a first composition consisting of zinc, aluminum and silicon, the silicon content ranging from 0.005% by weight up to saturation and the aluminum content being at least 0.05% but less than approximately 0.15%, to form a zinc-coated sheet while preventing formation of iron-zinc bottom dross in the bath;

b) subjecting the zinc-coated sheet to a diffusion heat treatment to convert the layer of zinc present on the zinc-coated sheet into a zinc-iron alloy;

c) raising the aluminum content of the bath to more than approximately 0.15% but not more than 0.5% to form a second composition and passing a second quantity of steel sheet through the second composition of the bath to form a galvanized steel sheet while preventing formation of aluminiferous floating dross in the bath and maintaining the aluminum content of the bath substantially constant; and d) recovering the galvanized steel sheet as a coated steel sheet without subjecting the coated sheet to a diffusion heat treatment.

2. The process according to claim 1, wherein:

the first composition for production of the sheet coated with the iron-zinc alloy contains at least 0.10% of aluminum.

3. The process according to claim 1, wherein:

the first and second compositions each contain at least 0.01% of silicon.

4. The process according to claim 1, wherein:

the first and second compositions each contain at most 0.10% of silicon.

5. The process of claim 1 further comprising the step of compensating for consumption of at least one of the first and second compositions during steel sheet production by adding to at least one of the first and second compositions one of:

i) a zinc alloy having a silicon content of 0.05 to 1.5% and an aluminum content essentially equal to the aluminum content of the at least one of the first and second compositions; and ii) a combination of elemental zinc and at least one master alloy, this combination having a mean silicon content of 0.05 to 1.5% and a mean aluminum content essentially equal to the aluminum content of the at least one of the first and second compositions.

6. A process for producing galvanized steel sheet, comprising the steps of:

a) passing a process steel sheet through a bath having a composition consisting of zinc, aluminum and silicon, the silicon content ranging from 0.005% by weight up to saturation, and the aluminum content being more than approximately 0.15% but no more than 0.5% to form a galvanized steel sheet while preventing formation of aluminiferous floating dross in the bath and maintaining the aluminum content of the bath substantially constant; and b) recovering the galvanized steel sheet as a coated sheet without subjecting the coated sheet to a diffusion heat treatment.

7. The process of claim 6 wherein the silicon content ranges between 00.1 and 0.10%.

8. The process of claim 6 further comprising the step of:

compensating for consumption of the composition during steel sheet production by adding to the bath composition of the bath one of:

i) a zinc alloy having a silicon content of 0.05to 1.5% and an aluminum content essentially equal to the aluminum content of the composition; and ii) a combination of elemental zinc and at least one master alloy, this combination being added having a mean silicon content of 0.05 to 1.5% and a mean aluminum content essentially equal to the aluminum content of the composition.

* * * * *